US005167560A

United States Patent [19]

Lubiniecki

[11] Patent Number: 5,167,560

[45] Date of Patent: Dec. 1, 1992

[54] TOY FIRE FIGHTING DISPLAY

[76] Inventor: Bernie Lubiniecki, Box 511, Sturgis, SK S0A-4A0, Canada

[21] Appl. No.: 818,245

[22] Filed: Jan. 8, 1992

[51] Int. Cl.[5] ..... A63H 33/42

[52] U.S. Cl. ..... 446/166; 446/167; 446/475

[58] Field of Search ..... 446/155, 156, 159, 166, 446/167, 168, 169, 173, 199, 475, 476, 483

[56] References Cited

U.S. PATENT DOCUMENTS

| | | | |
|---|---|---|---|
| 1,627,270 | 5/1927 | Burnham | 446/166 X |
| 1,640,417 | 8/1927 | Marks | 446/180 |
| 3,253,354 | 5/1966 | Gollner et al. | 446/153 X |
| 3,665,638 | 5/1972 | Weistrop | 446/166 |
| 3,789,541 | 2/1974 | Good et al. | 446/432 X |
| 4,122,627 | 10/1978 | Kubiatowicz | 446/156 |
| 4,246,719 | 1/1981 | Kulesza et al. | 446/153 X |

*Primary Examiner*—Robert A. Hafer
*Assistant Examiner*—Sam Rimell
*Attorney, Agent, or Firm*—H. Jay Spiegel

[57] ABSTRACT

A toy fire fighting display is disclosed which includes a toy building having areas of structure simulating that the building is on fire. Spraying of water at some of these areas causes a chamber to fill with water causing a float to rise causing changing of the appearance of the scene. At another area, sprayed water at an area causes a container to fill with water and to descend to eliminate the appearance of a fire. A toy fire hydrant and truck are also disclosed.

7 Claims, 4 Drawing Sheets

TOY FIRE FIGHTING DISPLAY

BACKGROUND OF THE INVENTION

The present invention relates to a toy fire fighting display. In the prior art, toy buildings and toy fire trucks are known, however, Applicant is unaware of any prior art teaching all of the features and aspects of the present invention.

The following prior art is known to applicant:

U.S. Pat. No. 1,640,417 to Marks teaches a pumping toy fire engine including a pumping mechanism allowing the pumping of water therefrom. The present invention differs from the teachings of Marks as contemplating a toy building having simulated fire scenes which may be eliminated by spraying water thereon.

U.S. Pat. No. 2,020,196 to Mallgraf discloses a toy house having large windows allowing one to view the interior thereof. However, Mallgraf fails to contemplate the significant aspects and features of the present invention including the use of simulated fire scenes which may move responsive to the spraying of water thereon.

U.S. Pat. No. 3,789,541 to Good et al. discloses a toy vehicle pumper including a fire truck with a pumping mechanism allowing the pumping of water therefrom. Again, Good et al. fail to contemplate the building structure of the present invention.

SUMMARY OF THE INVENTION

The present invention relates to a toy fire fighting display. The present invention includes the following interrelated objects, aspects and features:

(a) In a first aspect, the present invention contemplates a toy simulative building having walls, a roof and simulated windows.

(b) Some of the simulated windows have a fixed backdrop having a scene displayed thereon resembling the interior of a burning building. Below these windows, a watertight chamber is provided having a float therein carrying a simulative scene which may move in front of the fixed scene to completely obscure it, responsive to water filling the chamber. Water may fill the chamber by spraying of water on the fixed scene.

(c) On the roof of the building, a scene is displayed which appears to be flames extending upwardly therefrom. This scene is mounted on a container hanging from resilient bands. When water is sprayed on this scene, the water fills the container which proceeds to descend into the toy building thereby removing this fire scene from view.

(d) The present invention also contemplates a fire hydrant connectable to the water supply of a home by a coupling designed to attach to a common garden hose. This hydrant may be used to supply water to a toy fire truck having a selector valve allowing selection of a particular toy fire hose which is to be employed.

As such, it is a first object of the present invention to provide a toy fire fighting display.

It is a further object of the present invention to provide such a device having a plurality of scenes simulating fires, which scenes may be removed from view by spraying water thereon.

It is a still further object of the present invention to provide such a device including a simulated fire hydrant and fire truck.

These and other objects, aspects and features of the present invention may be better understood from the following detailed description of the preferred embodiment when read in conjunction with the appended drawing figures.

SPECIFIC DESCRIPTION OF THE PREFERRED EMBODIMENT

Figure 1:
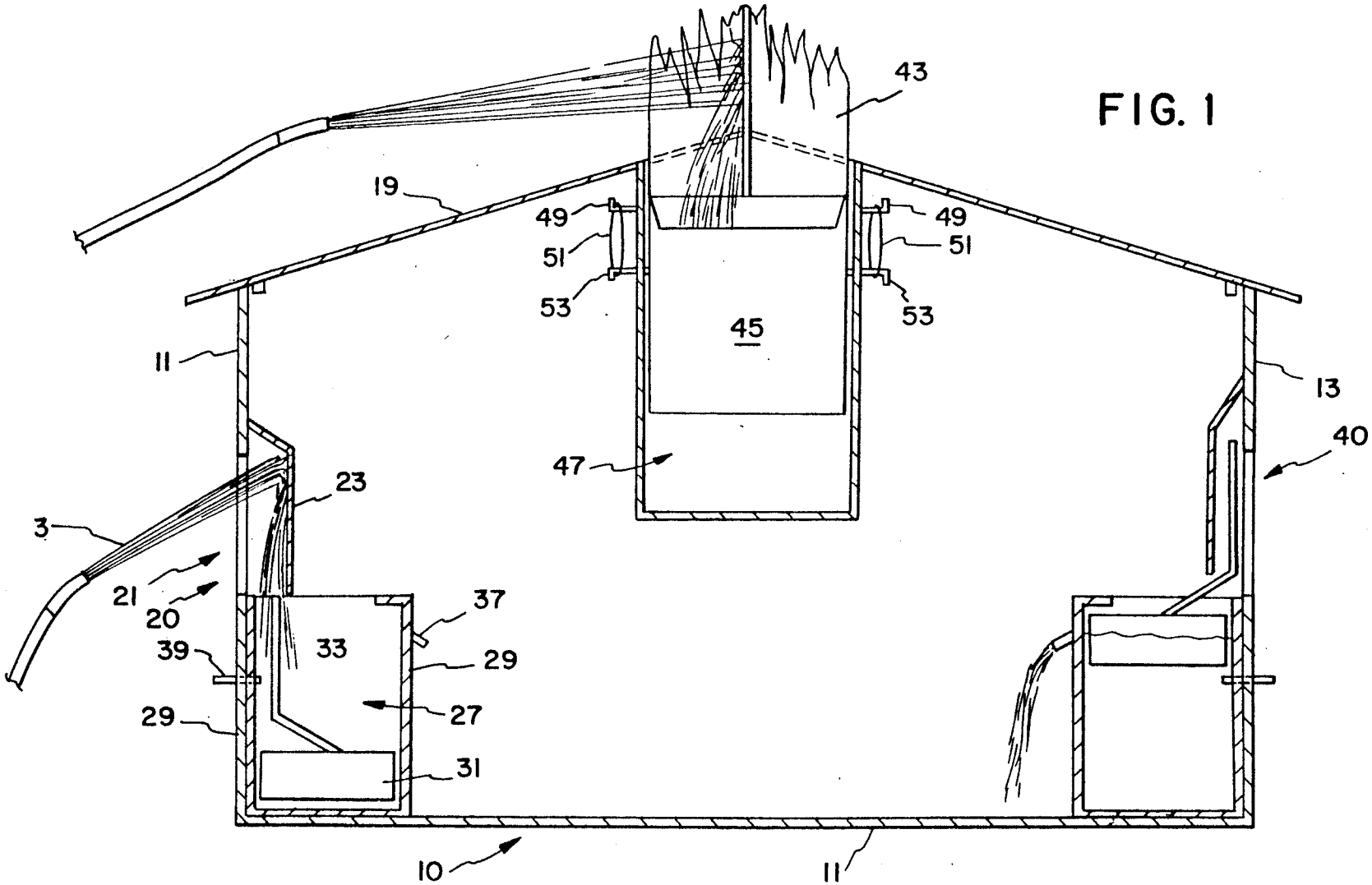
FIG. 1 shows a cross-sectional view through a simulated toy building.
Figure 2:
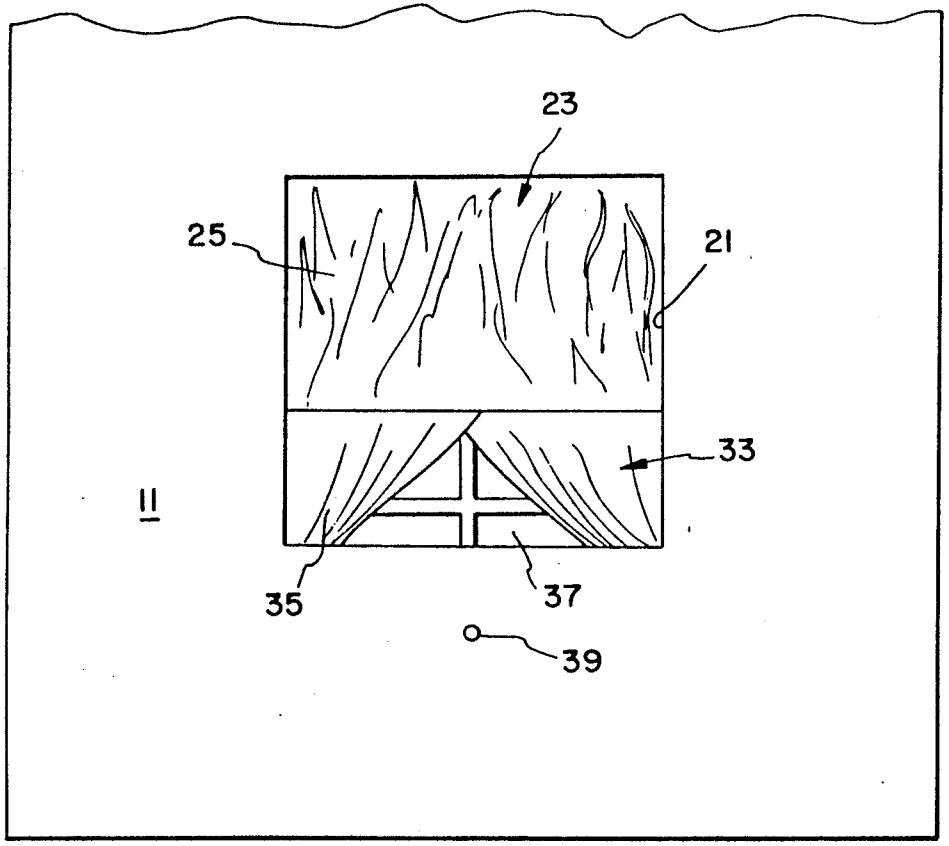
FIG. 2 shows a side view of the building illustrated in FIG. 1.
Figure 3:
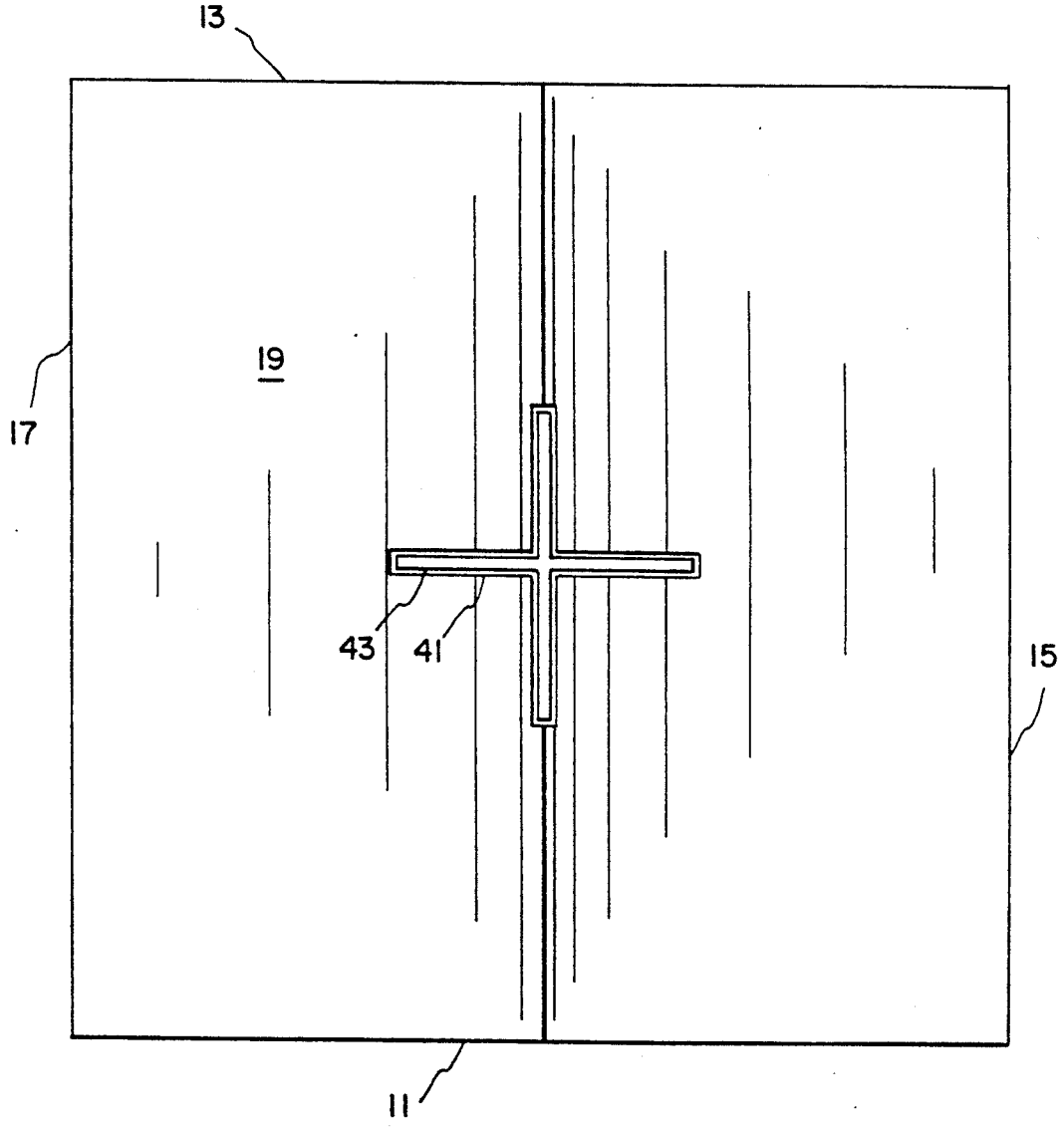
FIG. 3 shows a top view of the inventive building.

With reference, first, to FIGS. 1, 2 and 3, a building is generally designated by the reference numeral 10 and is seen to include a bottom wall 11, side walls 11 and 13, front and rear walls 15 and 17, and a roof 19.

With reference to FIGS. 1 and 2, a fire scene 20 includes a simulated window 21 having a fixed backdrop 23 with a scene 25 thereon made to resemble a fire in progress within the home 10.

With further reference to FIGS. 1 and 2, immediately below the backdrop 23, a chamber 27 is formed by walls 29 and contains a float 31 having attached thereto a scene 33, partially seen in FIG. 2 to resemble a normal home window including curtains 35 and windowpanes 37. The chamber 27 includes an overflow outlet 37, and a lock pin 39 extends through the wall 11 of the house 10 so that when the float 31 has floated upwardly above the lock pin, the lock pin may be reciprocated to lock the float 31 in a position with the scene 33 covering the backdrop 23.

As should be understood from FIG. 1, a toy hose 1 may spray water 3 at the backdrop 23, which water 3 hits the backdrop 23 and falls downwardly filling the chamber 27 and thereby causing the float 31 to rise to a position wherein the scene 33 rises to cover the backdrop 23. Thus, with the backdrop 23 initially in view, it appears that the interior of the house 10 is on fire. However, the water 3 filling the chamber 27 causes the scene 33 to rise to thereby give the appearance that the fire has been put out and the home has been restored to a normal condition.

FIG. 1 also shows a scene 40 which is substantially the same as the scene 20 and, as such, will not be described in detail. Of course, the scene thereof displayed on the backdrop thereof may differ from the scene displayed on the backdrop 23 and the scene displayed on the float attached scene thereof may differ from the scene 33.

With reference, now, to FIGS. 1 and 3, the roof 19 has a cross-shaped opening 41 through which may reciprocate a cross-shaped scene 43 mounted on a container 45 suspended within a chamber 47 supported under the roof 19. Walls of the chamber 47 have outwardly extending hooks 49 from which depend elastic bands 51. The container 45 has two hook members 53 extending laterally therefrom through slots (not shown) in the chamber 47, and these hook members have attached thereto the bands 51. Thus, the chamber 45 is suspended under the roof 19 by the structure including the bands 51.

The scene 43 may be made to resemble a roof fire and, due to its cross-shape, this fire scene may be visible in all directions. Additionally, the cross-shape of the scene 43 allows the user to spray water thereon from any one of four directions, with this water descending through spaces formed between the scene 43 and the opening 41 in the roof 19. Such water will descend into the container 45 which catches the water and causes the container 45 to become heavier, thereby causing the container 45 to descend within the chamber 47 against the upward force placed thereon by the bands 51.

Thus, as water is sprayed on the scene 43, the container 45 fills with water, and subsequently descends into the chamber 47, thereby removing the scene 43 from view. Thus, spraying of water on the scene 43 causes the appearance of a fire to subsequently disappear.

Figure 4:
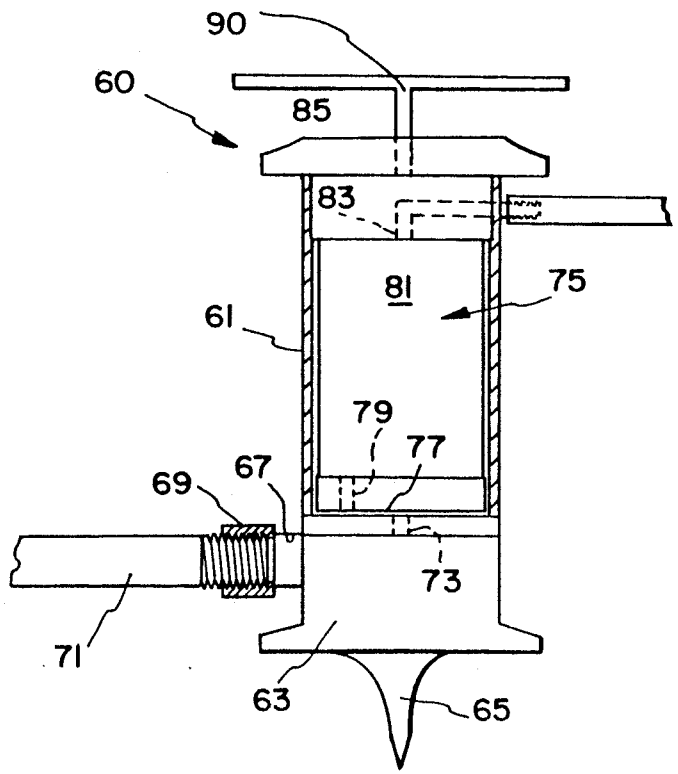
FIG. 4 shows a cross-sectional view through a toy fire hydrant made in accordance with the teachings of the present invention.
Figure 5:
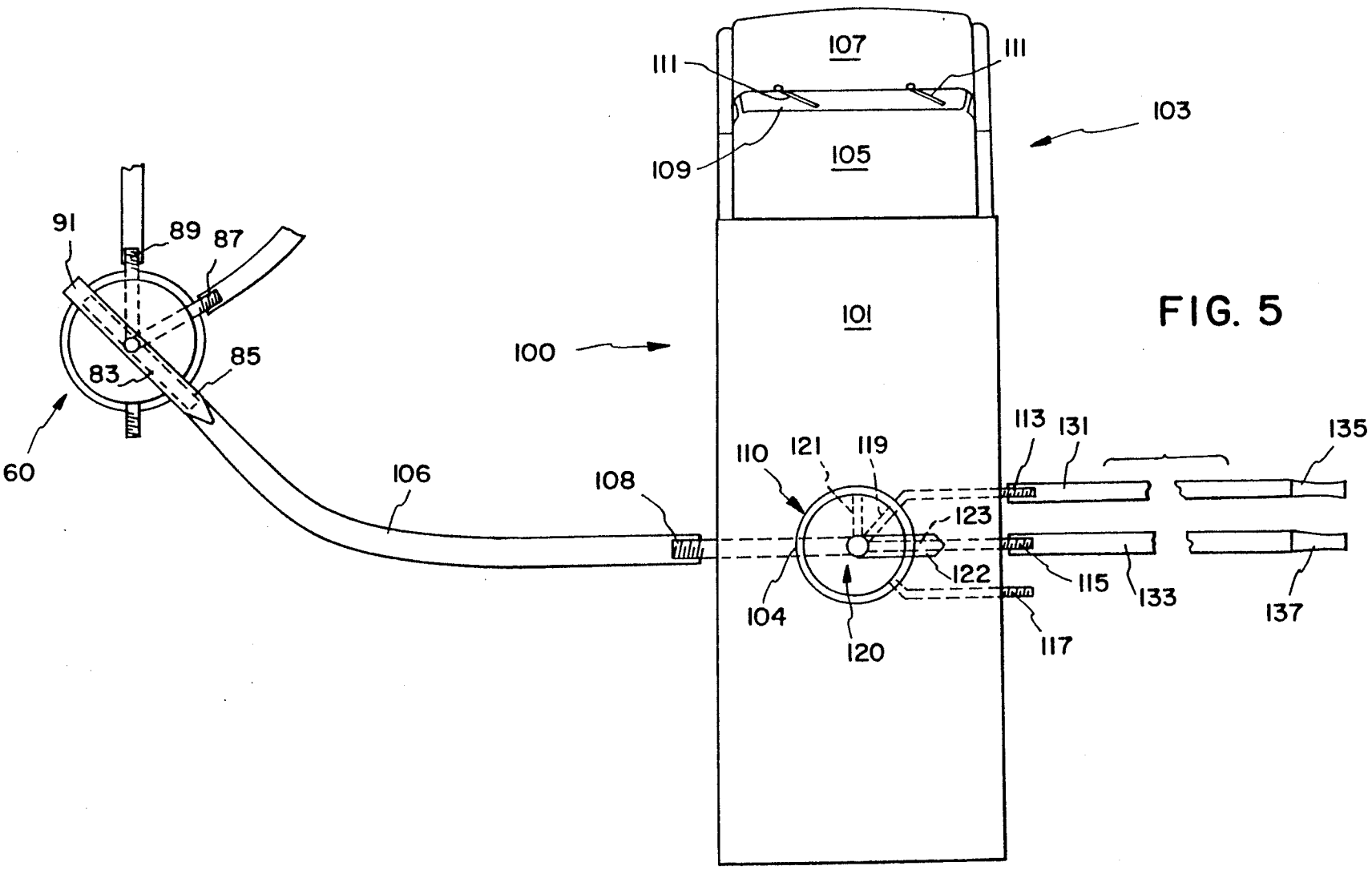
FIG. 5 shows a schematic representation, from above, of the fire hydrant of FIG. 4 coupled via a toy hose to a fire truck made in accordance with the teachings of the present invention.

With reference, now, to FIGS. 4 and 5, the toy fire hydrant and fire truck made in accordance with the teachings of the present invention will now be described.

As shown in FIGS. 4 and 5, the hydrant is generally designated by the reference numeral 60 and is seen to include a body 61 having a base 63 with a ground insertable spike 65 allowing the base 63 to be stabilized. The base 63 also includes a fluid port 67 with a coupling 69 thereon designed to couple to the corresponding coupling of a standard garden hose 71.

The port 67 leads to an internal chamber in the base 63 having an outlet 73 leading to a valve 75 via a gap 77 between the valve 75 and the port 73.

As seen in FIG. 4, the valve 75 has an inlet port 79, a chamber 81 and an L-shaped outlet port 83.

As seen in FIG. 5, the outlet port 83 may be aligned with any one of a plurality of outlets 85, 87, 89 or 91 to allow flow of water therefrom. Of course, the outlet port 83 may be misaligned with the outlet ports 85, 87, 89 and 91 to close the valve 75.

An actuator handle 90 is attached to the valve 75 so that rotations of the handle 90 result in corresponding rotations of the valve 75.

If desired, the outlet ports 85, 87, 89 and 91 may differ from one another as each having a unique outlet area. Thus, the user may select outlet pressure by selecting a particular outlet of a particular outlet cross-sectional area.

With reference to FIG. 5, in particular, a toy fire truck 100 is seen to include a body 101 and a cab 103 having a roof 105, a hood 107, a windshield 109 and windshield wipers 111.

The body 101 includes a selector valve 110 interposed between an inlet port 108 and outlet ports 113, 115 and 117. The inlet port 108 may be connected with one of the outlet ports 85, 87, 89 or 91 of the hydrant 60 by virtue of a toy hose 106. The valve 110 may be similar in design to the hydrant 60 including a single inlet port 104 and an outlet port 119 rotatable to interconnect with any one of the outlet ports 113, 115 or 117. Alternatively, a plurality of outlet ports including the outlet port 119 and additional outlet ports 121 and 123 may be provided so that through rotations of the valve head 120, by movements of the actuating handle 122, various combinations of alignment between the outlet ports 119, 121 and 123 of the valve 120 and the ports 113, 115 and 117 of the truck may be accomplished. Of course, misalignment of these various ports will result in closing of the valve 110.

As shown in FIG. 5, toy hoses 131 and 133 may be connected to outlet ports 113 and 115 with another such hose (not shown) being selectively connectable to the outlet port 117. In this way, water from the garden hose 71 may be controlled and regulated by the hydrant 60, may be supplied to the fire truck 100 and may be sprayed from the nozzles 135, 137 of the toy fire hoses 131, 133, respectively, so that water may be sprayed on the various scenes of the building 10 to simulate putting out of a fire.

As such, an invention has been disclosed in terms of a preferred embodiment thereof, which fulfills each and every one of the objects of the invention as set forth hereinabove and provides a new and improved toy fire fighting display of great novelty and utility.

Of course, various changes, modifications and alterations in the teachings of the present invention may be contemplated by one skilled in the art without departing from the intended spirit and scope thereof.

As such, it is intended that the present invention only be limited by the terms of the appended claims.

I claim:

1. A toy building comprising:

a) at least one side wall with a recessed area of said side wall having a backdrop with a simulative design thereon resembling a fire in an interior of a building;

a) a chamber below said backdrop and containing a float carrying an upwardly extending member having a simulative scene thereon;

a) an opening in said wall in front of said backdrop and above said chamber whereby water directed at said backdrop falls through said opening and fills said chamber with said float and upwardly extending member rising to obscure said backdrop.

2. The invention of claim 1 wherein said simulative scene comprises an appearance of a typical home window.

3. The invention of claim 1, wherein said building has a further side wall with a further recessed area of said further side wall having a further backdrop with a further simulative design thereon, a further chamber below said further backdrop and containing a further float carrying a further upwardly extending member having a further simulative scene thereon and a further opening between said further backdrop and said further chamber.

4. The invention of claim 1, wherein said building further includes a roof having an opening therein, a chamber below said opening in said roof supported below said roof and a container in said chamber, said container being supported in said chamber for vertical movements with respect thereto by a resilient support, said container including an upstanding member movable into view through said roof opening and having a design thereon.

5. The invention of claim 4, wherein a gap is formed in said roof opening when said upstanding member is exposed, whereby water sprayed into said gap fills said container causing said upstanding member to descend into said chamber.

6. The invention of claim 1, further including a toy hydrant having a base with a group insertable spike and a coupling for attachment to a water supply, said hydrant having a valve movable between open and closed positions to control flow of water therethrough, said hydrant supplying water to a toy fire truck having at least one toy fire hose for spraying water at said toy building.

7. The invention of claim 6, wherein said toy fire truck has a water valve for controlling water flow between said hydrant and said fire hose.

* * * * *